United States Patent [19]

Work

[11] 4,291,968

[45] Sep. 29, 1981

[54] DAYLIGHT DEVELOPING APPARATUS FOR PHOTOGRAPHIC FILM

[76] Inventor: Gerald Work, E. 1701 20th, Spokane, Wash. 99203

[21] Appl. No.: 97,374

[22] Filed: Nov. 26, 1979

[51] Int. Cl.[3] ..... G03D 3/00

[52] U.S. Cl. ..... 354/313; 354/316; 354/337

[58] Field of Search ..... 354/307, 310, 311, 312, 354/313, 314, 315, 316, 329, 330, 331, 337

[56] References Cited

U.S. PATENT DOCUMENTS

| | | | |
|---|---|---|---|
| 2,212,357 | 8/1940 | Vanderwalker | 354/337 |
| 2,733,645 | 2/1956 | Rose et al. | 354/313 |
| 3,668,997 | 6/1972 | Ratowsky | 354/330 |
| 3,978,505 | 8/1976 | Lever | 354/307 |
| 4,001,852 | 1/1977 | Gall | 354/313 |
| 4,168,117 | 9/1979 | Work | 354/331 |

FOREIGN PATENT DOCUMENTS

| | | | |
|---|---|---|---|
| 192598 | 8/1937 | Switzerland | 354/331 |

*Primary Examiner*—L. T. Hix

*Assistant Examiner*—Alan Mathews

*Attorney, Agent, or Firm*—Wells, St. John & Roberts

[57] ABSTRACT

A daylight developing apparatus is described for developing photographic film under daylight conditions. The apparatus includes a tank unit having one or more wells for receiving photographic film treating liquid. A light impermeable film carrier is provided to receive the film and immerse the photographic film in the treating liquids. The carrier has liquid passageways both top and bottom with accompanying light traps to permit the treating liquid to flow into the carrier through the bottom liquid passageway as the carrier is lowered into a well. After sufficient contact between the film and the treating liquid, the carrier is lifted from the well with the treating liquid completely draining from the carrier through the bottom of the carrier. The carrier is provided with inclined surfaces to completely drain chemical from the carrier so as not to contaminate the liquid in the adjacent well. The tank unit has a unitary water jacket to maintain all of the treating liquids at the same temperature.

3 Claims, 11 Drawing Figures

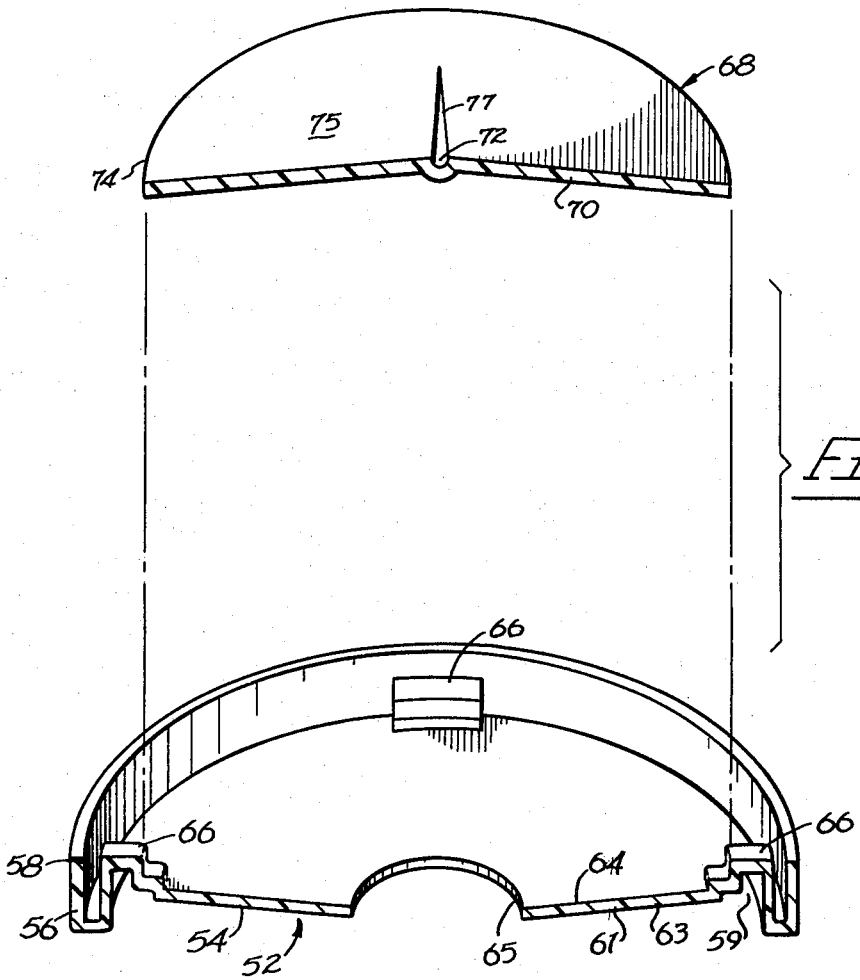
FIG 4
FIG 5
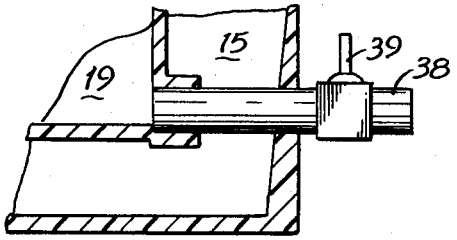

FIG 6
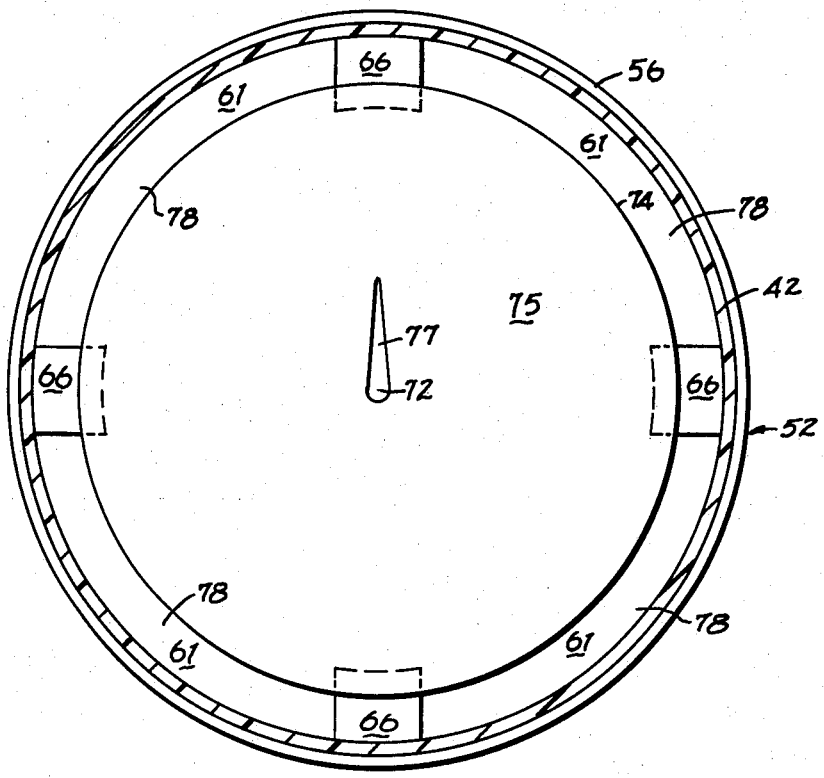
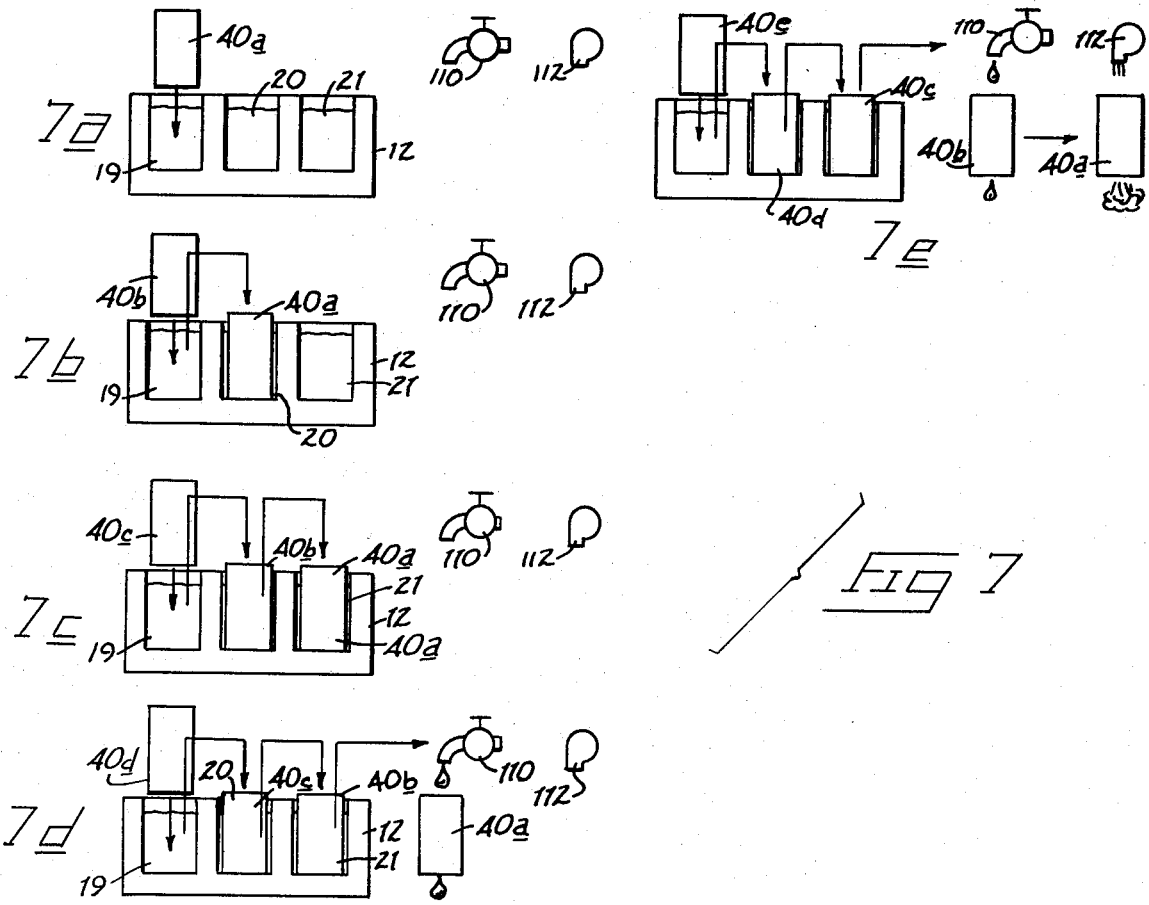
FIG 7

DAYLIGHT DEVELOPING APPARATUS FOR PHOTOGRAPHIC FILM

BACKGROUND OF THE INVENTION

This invention relates to daylight developing apparatus for exposed photographic film.

Expensive and complicated equipment is available to commercial film processing businesses for rapidly processing photographic materials under daylight conditions. Such equipment generally occupies a substantial floor space and is quite expensive. Such equipment is normally beyond the means of the amateur photographer or the small professional studio.

One of the principal objects and advantages of this invention is to provide daylight developing apparatus for developing film that is principally directed to the amateur photographer or small professional studio to enable such persons to economically and efficiently develop film of high order resultant image perfection.

An additional object of this invention is to provide relatively inexpensive equipment for the home photography industry that enables the photographer to rapidly develop film without having to touch the film once the film has been mounted onto developing reels or supports.

These and other objects and advantages of this invention will become apparent upon reading the following detailed description of a preferred embodiment.

BRIEF DESCRIPTION OF THE DRAWINGS

A preferred embodiment of this invention is illustrated in the accompanying drawings, in which:

FIG. 4 is an isometric exploded view of a lower end enclosure means of the photographic film carrier;

FIG. 5 is a fragmentary vertical cross-sectional view taken along line 5—5 in FIG. 1;

FIG. 6 is a horizontal cross-sectional view of the photographic film carrier taken along line 6—6 in FIG. 1; and FIG. 7 is a series of schematic views *7a–7e* showing the sequence of movement of the carrier through a series of processing steps to fully develop photographic film.

DETAILED DESCRIPTION OF A PREFERRED EMBODIMENT

Figure 1:
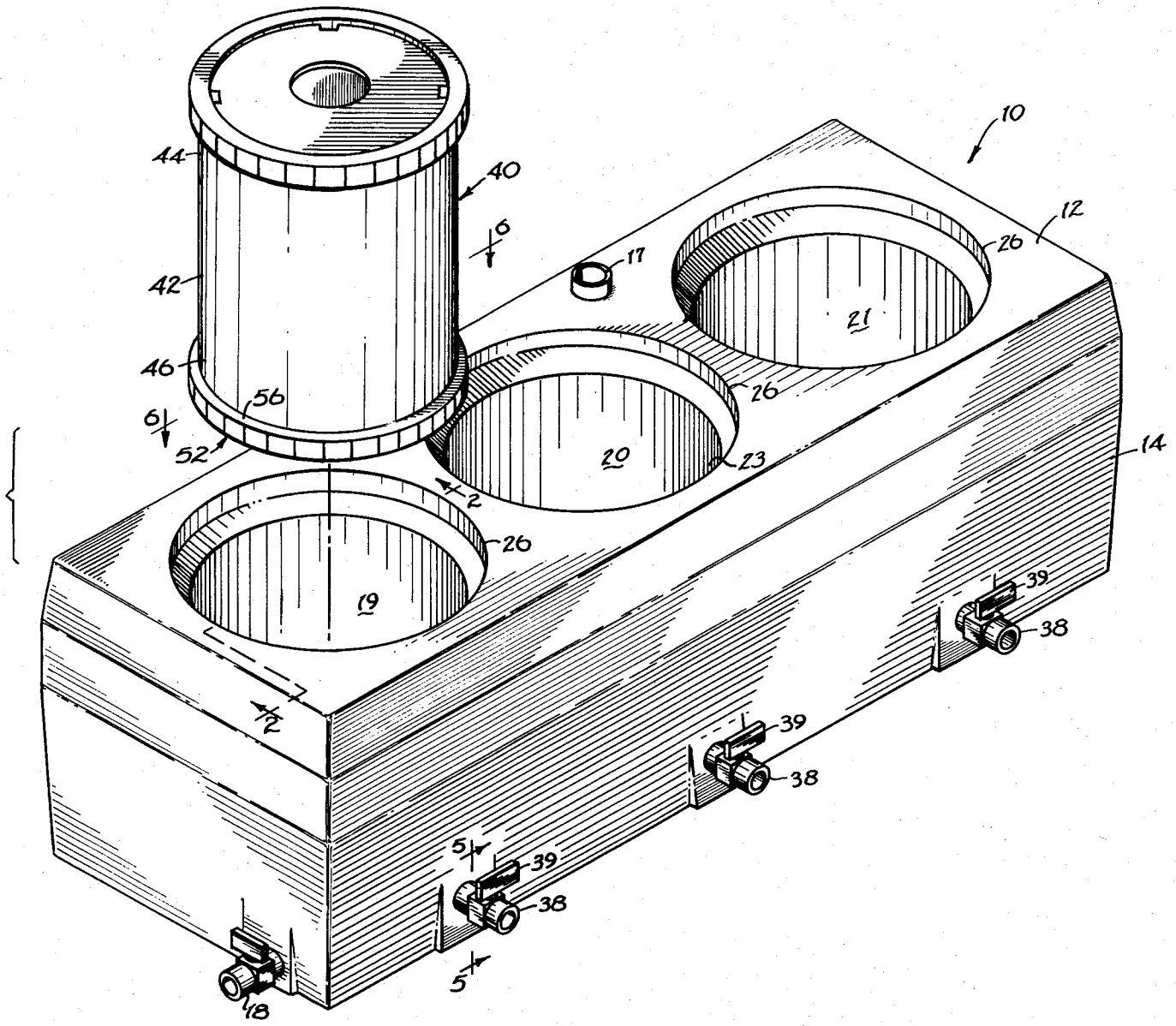
FIG. 1 is an isometric view of the subject apparatus illustrating a developing tank having a plurality of recesses showing a single daylight photographic film developing carrier being inserted into one of the recesses.
Figure 2:
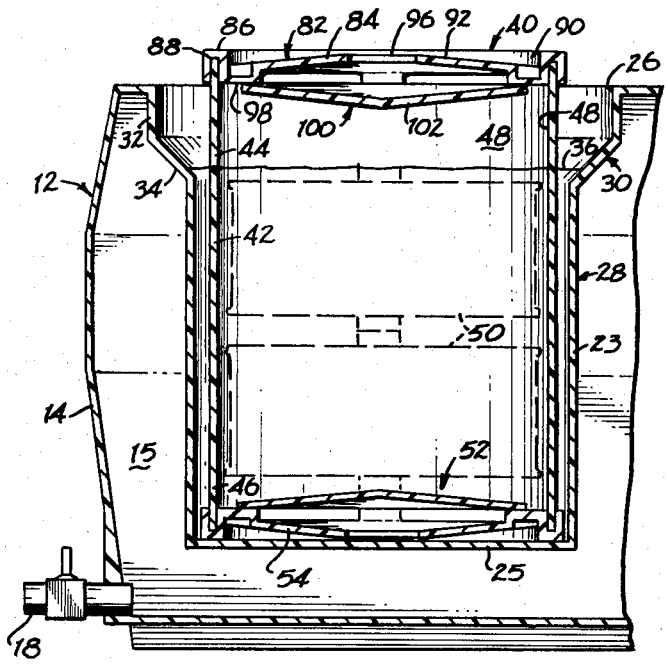
FIG. 2 is a vertical cross-sectional view of a portion taken along line 2—2 in FIG. 1 illustrating a photographic film developing carrier positioned within one of the recesses of the developing tank.
Figure 3:
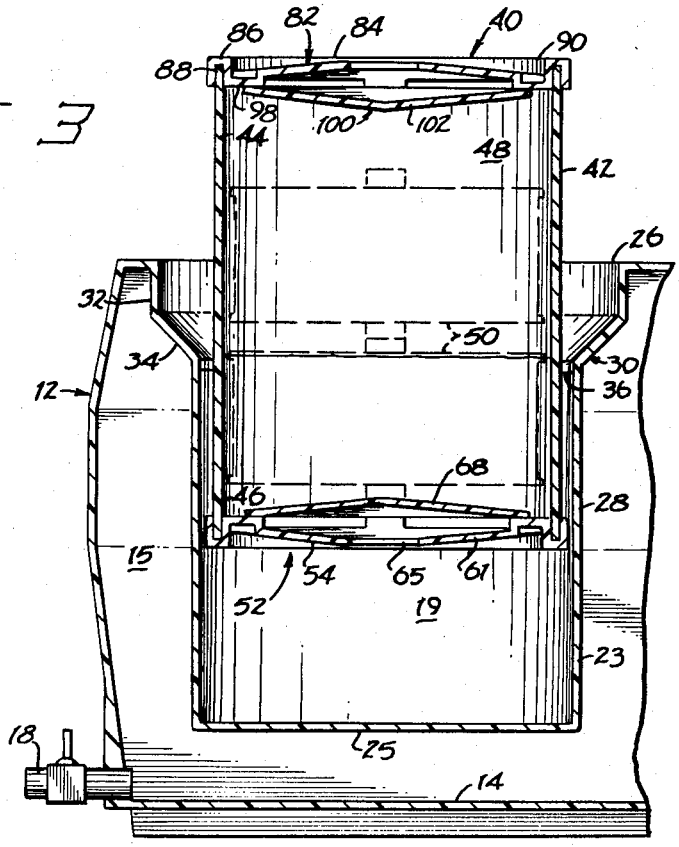
FIG. 3 is a cross-sectional view similar to FIG. 2 except showing the carrier being partially removed from the tank recess.

Referring to FIG. 1 there is illustrated a daylight developing apparatus for developing photographic film in which the apparatus is generally designated with the numeral 10. The apparatus includes a photographic developing tank unit 12 that includes a portable housing 14 that is of a unitary construction containing a water jacket cavity 15 (FIGS. 2 and 3). The housing includes a water inlet fixture 17 along a top surface of the housing 14 for emitting a temperature control liquid such as heated water for maintaining all of the photographic film treating liquids at a common desired temperature. The housing 14 includes an outlet 18 (FIGS. 1 and 2) for draining the liquid from the water jacket cavity 15 or for interconnecting the housing 14 to an adjacent tank unit to provide a multiple unit flow through system.

The tank unit 12 may have one or more recesses or wells depending upon the technique and the chemicals utilized for daylight developing. In the preferred embodiment illustrated in FIG. 1, the tank unit 12 has three spaced recesses or wells 19, 20 and 21. The recesses 19–21 recede downwardly from the top surface with an upright wall 23 extending to a bottom wall 25 that is spaced slightly above the bottom of the housing 14. The upright wall 23 may have a variety of cross sections depending upon the shape and type of film being developed. In the preferred embodiment, the upright wall 23 has a cylindrical shape about a recess or well axis. Each of the recesses 19–21 have an opening 26 coincident with the upper surface of the housing 14. The upright wall 23 has a lower wall section 28 that extends from the bottom wall 25 upwardly a substantial portion of the height of the recess to an upper wall section 30. The upper wall section 30 has an enlarged wall portion 32 defining the opening 26 that has a diameter substantially greater than the lower wall section 28. The upper wall section 30 includes an inclined wall portion 34 extending from the enlarged wall section 32 inward and downward to the lower wall section 28.

Each of the recesses 19–21 receive photographic film treating fluid having intended liquid levels immediately below the inclined wall portion 34. The enlarged wall portion 32 and the inclined portion 34 provide for a liquid surge volume to prevent treating liquid from overflowing as the film is being loaded into the recesses. The inclined wall portion 34 additionally assists in the alignment and placement of the photographic film within each recess. Each recess 19, 20 is filled to a liquid level indicated by the numeral 36 (FIGS. 3 and 3).

Tank unit 12 further includes individual drain lines 38 (FIG. 5) that extend from each recess 19–20 to exterior valves 39 so that each recess 19–21 may be individually drained as desired.

The daylight developing apparatus 10 further includes a daylight photographic film carrier generally designated with the numeral 40 for receiving photographic film therein and for immersing the photographic film in the photographic treating liquid contained in the recesses. The apparatus 10 may include one or more film carriers 40 depending upon the number of recesses 19–20 and the techniques and desires of persons developing the photographic film.

The film carrier 40 preferably has an upright wall 42 with a tubular cross section complementary to the upright wall 23. In the preferred embodiment, the upright wall 42 is cylindrical and extends from an upper end 44 to a lower end 46. The upright wall 42 preferably has a length slightly greater than the height of the upright wall 23 so that the upper end 44 extends above the opening 26 as illustrated in FIG. 2.

The upright wall 42 provides an internal cavity 48 for receiving the photographic film. In the preferred embodiment, cavity 48 is cylindrical for receiving one or more developing film reels or supports 50. In the design illustrated in FIGS. 2 and 3 the carrier 40 is designed to carry two superimposed developing film reels 50. Preferably the film is taken from a cassette, roll or cartridge and mounted onto the reels. The most common types of film are 135 mm, 120 mm, or 126 mm. The reels 50 are loaded into the carriers 40 in a darkroom.

The daylight photographic film carrier 40 includes a lower end closure means generally designated with the numeral 52 that is mounted to the lower end 46 for enclosing the lower end of the cavity 48. The lower end enclosure means 52 includes a bottom wall 54 (FIG. 4) that has a peripheral rim 56 that mounts to the lower end 46. The peripheral rim 56 includes an annular groove 58 to receive the lower end 46 of the upright wall 42. Preferably the lower end 46 is cemented in the groove 58 to provide a strong liquid seal and to prevent the enclosure means 52 from being removed from the upright wall 42.

The bottom wall 54 includes an annular indentation 59 radially inside the peripheral rim 56. The bottom wall 54 includes a frusto-conical bottom wall section 61 that extends from the indentation 59 radially inward and downward to a central apex opening 65 that is concentric with the axis of the upright wall 42. The frusto-conical bottom wall section 61 includes an exterior conical surface 63 and an interior conical surface 64 that slope downward to the central apex opening 65.

Angularly spaced brackets 66 are formed along the upright wall 42 at angularly spaced locations for receiving a lower end light baffle 68. The light baffle 68 includes a conical wall 70 that overlays the central apex opening 65 and frusto-conical bottom wall section 61. The conical wall 70 extends from a central apex 72 aligned concentrically with the axis of the upright wall 42 and extends radially outward and downward terminating in an angular periphery 74 that rests on the brackets 66. The brackets 66 support the conical wall 70 vertically spaced from the frusto-conical wall 61 and radially spaced from the upright wall 42 to provide a liquid passageway 78 (FIG. 6) that extends along the upright wall 42 to permit treating liquid to flow past the angular periphery 74. The conical wall 70 has a conical surface 75 that defines the lower part of the cavity 48. A drain groove 77 is formed in the conical surface 75 extending from the apex 72 radially outward for draining any treating liquid from the hub of the film reels 50.

The daylight photographic film carrier 40 further includes an upper end enclosure means 82 that is mounted at the upper end 44 of the upright wall 42 enclosing the cavity 48 at the upper end. In a preferred embodiment, the upper end enclosure means 82 is constructed identically to the lower end enclosure means 52. When placed on the upper end 44 the enclosure means 82 is a mirror image of the lower end enclosure means 52. However, the upper end enclosure means 82 is preferably removably mounted to the upright wall 42. The upper end enclosure means 82 includes a top wall 84 that has a peripheral rim 86 with an annular groove 88 formed therein to receive the upper end 44 to provide a liquid tight seal. The top wall 84 includes an annular indentation 90 spaced radially inward from the peripheral rim 86. The top wall 84 then extends in a frusto-conical top wall section 92 from the annular indentation 90 inward and upward to a central apex opening 96 that is concentrically positioned with respect to the axis of the upright wall 42.

Brackets 98 formed on the top wall 94 extend downwardly for supporting an upper end light baffle 100. The upper end light baffle 100 has a conical wall 102 that extends from an apex radially outward and upward to an annular periphery that engages and is supported by brackets 98. The brackets 98 are positioned at angularly spaced locations with a fluid passageway provided between the angular periphery and the upright wall 42 to permit air or liquid to pass therethrough.

It should be noted in FIGS. 2 and 3 that an angular rim 56 of the lower end enclosure means 52 extends downwardly and is vertically spaced from the central apex opening 65 so that the rim provides a surface support with the opening 65 being vertically spaced to permit liquid to drain through the central apex opening 65 should the carrier set on the surface. Similarly, the peripheral rim 86 is likewise vertically spaced from the central apex opening 96 so that should the carrier be inverted the peripheral fim 86 will engage the surface with the central apex opening 96 being spaced from the surface to permit adequate draining.

The operation of the daylight developing apparatus will be described with respect to FIG. 7. In FIG. 7 it will be assumed that the tank unit 12 contains a developing liquid in recess 19, a stop or rinse liquid in recess 20 and a blix liquid in recess 21. A blix liquid is a combination of a bleach and fixing solution.

Initially the film is loaded onto the film reel 50 in a darkroom. The upper end enclosure means 82 is removed with the film reels 50 being loaded into the carrier 40 as illustrated in FIGS. 2 and 3. The upper end closure means 82 is then inserted onto the upper end 44. From this point on, the entire film developing process may be conducted in daylight. Furthermore, the film need not be physically touched until the developed film is removed for enlarging. After the film has been loaded into the carrier 40, lights in the room may be turned on and the remainder of the steps executed in the daylight (with the room lights on). FIG. 7*a* shows the carrier 40*a* being lowered into cavity 19 containing the developing liquid. The developing liquid immediately passes upwardly through the central apex opening 65 and moves radially outward and upward along the interior surface 65 to the liquid passageways 78. The liquid then passes along the conical surface 75 into the cavity 48. The liquid level within the cavity 48 corresponds in height to the liquid level 36. The central apex opening 65 and the liquid passageways 78 are of sufficient size to permit the liquid to rapidly flow in either direction so as to maintain the liquid level within the carrier substantially equal to the liquid level outside the carrier 40*a*. Should the operator lower the carrier 40*a* into the recess 19 at an undesirable rate, the liquid in the recess will merely rise in the enlarged wall section 32 without spilling over the top of the housing opening 26. As the developing liquid passes into the cavity 48, the air exits from the cavity through the fluid passageway and the central apex opening in the upper enclosure means 82. The lower end light baffle 68 and the upper end light baffle 100 provide light traps to prevent light from entering the cavity 48. After a desired period of time, the operator grips the upper end enclosure means 62 and lifts the carrier 40*a* from the recess 19 as illustrated in FIG. 3. As the carrier 40*a* is raised from the recess 19, the developing chemical rapidly drains from the enclosure through the lower end enclosure means 52, with the liquid flowing downwardly and outward along the conical wall 70 through the liquid passageway 78. The liquid then flows inward and downward along the interior surface 64 and out the carrier through the central apex opening 65. The air is vented back into the cavity 48 through the upper end enclosure means 82. In a preferred embodiment the upper end enclosure 82 and the lower end enclosure 52 are identical so that the carrier 40*a* could be tipped upside down and operate equally as well.

The operator then moves the carrier 40*a* over and into the recess 20 which is filled with a stop bath or rinse solution. The rinse solution flows into the cavity donctacting the photographic material. While carrier 40*a* is in recess 20, a second carrier 40*b* may be placed in recess 19 (FIG. 7*b*).

FIG. 7*c* illustrates the container 40*a* being moved from the recess 20 to the blix liquid in recess 21. Carrier 40*b* is then moved to recess 20 and a new carrier 40*c* is loaded into recess 19.

FIG. 7*d* illustrates the carrier 40*a* being removed from the blix solution in cavity 21 and placed under a faucet (water source) 110 in which a wash solution such as water is passed into the cavity 48 to wash the film. The water enters through the upper end enclosure means 82 through the central apex opening 96. The liquid flows past the upper end light baffle 100 into the cavity 48 to wash the film. The water or wash bath then exits through the lower end enclosure means 52 as illustrated in 7*d*. Each of the subsequent carriers 40*b* and 40*c* are moved over one position with a new carrier 40*d* being placed in recess 19. It should be noted that each of the film treating liquids readily pass from the carrier through the lower end enclosure means 52 without the carrier containing any substantial liquid residue. Consequently, chemical contamination from one recess to the next recess is minimized. Consequently the process can be conducted rather rapidly in the transfer from one recess to another. It is not required that the carrier be thoroughly washed before transferring the film to a second chemical treatment step.

After the film in carrier 40*a* has been washed, it may be desirable to place the container on a storage shelf to permit the film to dry from natural currents. Because of the configuration of the lower end enclosure means 52 and the upper end enclosure means 82 air can readily circulate through the carrier to assist in natural drying. Alternatively the carrier 40*a*, as illustrated in FIG. 7*e*, may be placed in a moving airstream in which the air may be blown either down or up through the carrier 48 depending upon the equipment. FIG. 7*e* illustrates a blower 112 that may be utilized for generating heated air that will pass downward into the cavity 48 through the central apex opening 96 and out the cavity through the central apex opening 65.

It can be readily appreciated that the film once it is loaded into the carrier may be fully developed and ready for enlargement without having to be removed from the carrier at any stage during the developing process. As illustrated in FIG. 7 a number of carriers may be utilized to process a large amount of film in a rather short period of time. The entire operation, except for the loading of the film into the carrier, is conducted under daylight circumstances. The apparatus 10 enables an amateur or a small photographic studio to process a large amount of film on a very economic basis without large expenditures for automated daylight developing apparatus.

It is understood that the above described embodiment is merely illustrative of the principles of this invention and numerous other embodiments may be readily devised without deviating therefrom. Therefore, only the following claims are intended to define or limit this invention.

What is claimed is:

1. A daylight developing apparatus for developing photographic film without a darkroom, comprising:

a developing tank for receiving photographic treating liquid at a desired liquid level and for receiving a light impermeable photographic film carrier therein having photographic film therein to permit the film carrier to be lowered into the tank to immerse the photographic film in the photographic treating liquid below the desired liquid level without the photographic film being subjected to room light;

said carrier comprising a light impermeable upright side wall extending between an upper end and a lower end forming an interior cavity therein to receive the photographic film;

said carrier comprising a lower end enclosure means mounted to the lower end of the upright side wall;

said lower end enclosure means having liquid passage means formed to permit the photographic treating liquid to (1) flow into the cavity through the liquid passage means when the lower end is lowered into the tank with the liquid level in the cavity corresponding to the desired liquid level in the tank, and (2) flow out of the cavity when the lower end is raised from the tank;

said lower end enclosure means having a lower end light baffle means associated with the passage means forming a lower end light trap for preventing the entrance of light into the cavity through the lower end wall means while permitting the flow of liquid into and out of the cavity through the liquid passage means;

an upper end enclosure wall means mounted to the upper end of the upright side wall enclosing the cavity at the upper end;

said upper end enclosure wall means having a fluid passage means formed therein to permit air to flow out of the cavity when the lower end is lowered into the tank and to permit air to flow into the cavity when the lower end is raised from the tank;

said upper end enclosure wall means having a light baffle means associated with the fluid passage means forming an upper end light trap for preventing the passage of light into the cavity while permitting the flow of air into and out of the cavity through the fluid passage means; said developing tank having an upright tank wall forming a recess for receiving the photographic treating liquid and film carrier in which the upright tank wall includes a lower wall section having a reduced cross-sectional area and an upper wall section having an enlarged cross-sectional area to form a liquid surge reservoir with an inclined wall section that extends inward and downward to the lower wall portion to guide the film carrier downward into the recess from the upper wall section to the lower wall section and to enable surges of treating liquid from the recess in the lower wall section to flow upward and expand gradually outward along the inclined wall portion to the liquid surge reservoir should the carrier be lowered into the recess too rapidly to thereby prevent the treating liquid from squirting from or overflowing from the recess.

2. The daylight developing apparatus as defined in claim 1 wherein the tank has upright tank walls forming a recess for receiving the photographic treating liquid and the carrier and wherein the tank has a water jacket surrounding the tank wall to maintain the photographic treating liquid at a desired temperature.

3. A daylight photographic film developing carrier for receiving photographic film therein and for immersing the photographic film into a tank containing photographic film treating liquid to a preset liquid level, said carrier comprising:

an upright side wall extending between opposite ends forming a film developing cavity therein for receiving photographic film;

end enclosure means mounted to the opposite ends of the upright walls enclosing the cavity at the opposite ends;

said end enclosure means being mirror images of each other;

each end enclosure means having an unrestricted liquid passage means formed therein to permit the photographic film treating liquid to (1) rapidly flow into the cavity through the liquid passage means when the carrier is lowered into the tank with the liquid level in the cavity corresponding with the preset liquid level and (2) radially flow out of the cavity when the carrier is raised from the tank independently of which end enclosure means is first lowered into the treating liquid;

each end enclosure means having an end light baffle means associated with the liquid passage means forming an end light trap for preventing entrance of light into the cavity while permitting the flow of liquid into and out of the cavity independently of which end enclosure means is first lowered into the treating liquid;

wherein each unrestricted liquid passage means and each end light baffle means include incline surfaces for causing all of the photographic treating liquid to automatically drain from the cavity when the carrier is removed from the tank independently of which enclosure means is first lowered into the treating liquid;

wherein each end enclosure means includes a frustoconical bottom wall section extending downward and inward from the upright wall to a central apex aperture forming the liquid passage means to permit a liquid inflow and outflow through the central apex aperture;

wherein each end light baffle means includes a conical baffle wall overlying the bottom wall that extends from a central apex downward and outward toward the upright wall; and wherein each conical baffle wall includes a radial drain groove formed therein extending outward toward the upright wall for assisting in draining treating liquid from the photographic film.

* * * * *